US009997858B2

(12) United States Patent
Mogi et al.

(10) Patent No.: US 9,997,858 B2
(45) Date of Patent: Jun. 12, 2018

(54) ELECTRICAL CONNECTOR WITH DETACHABLE CONNECTING TERMINALS

(71) Applicant: HIROSE ELECTRIC CO., LTD., Tokyo (JP)

(72) Inventors: Toshiyuki Mogi, Tokyo (JP); Koichi Nakamura, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days. days.

(21) Appl. No.: 15/680,504

(22) Filed: Aug. 18, 2017

(65) Prior Publication Data

US 2018/0062298 A1 Mar. 1, 2018

(30) Foreign Application Priority Data

Aug. 29, 2016 (JP) ..... 2016-166705

(51) Int. Cl.

| | |
|---|---|
| ***H01R 13/40*** | (2006.01) |
| ***H01R 13/434*** | (2006.01) |
| ***H01R 9/22*** | (2006.01) |
| ***H01R 27/02*** | (2006.01) |
| ***H01R 13/422*** | (2006.01) |
| *H01R 13/424* | (2006.01) |
| *H01R 9/16* | (2006.01) |
| *H01R 13/52* | (2006.01) |
| *H01R 13/6581* | (2011.01) |
| *H01R 9/18* | (2006.01) |

(52) U.S. Cl.

CPC ..... *H01R 13/434* (2013.01); *H01R 9/223* (2013.01); *H01R 13/4223* (2013.01); *H01R 27/02* (2013.01); *H01R 9/16* (2013.01); *H01R 9/18* (2013.01); *H01R 13/424* (2013.01); *H01R 13/5202* (2013.01); *H01R 13/6581* (2013.01)

(58) Field of Classification Search

None

See application file for complete search history.

(56) References Cited

U.S. PATENT DOCUMENTS 4,386,816 A * 6/1983 Frear ..... H01R 13/424 439/595

4,387,943 A * 6/1983 Werth ..... H01R 13/424 439/595

(Continued)

FOREIGN PATENT DOCUMENTS

JP 2008-041600 2/2008

*Primary Examiner* — Tho D Ta

(74) *Attorney, Agent, or Firm* — Rankin, Hill & Clark LLP

(57) ABSTRACT

A connector including: a plurality of connecting terminals whose types are different from each other; and a housing including at least one terminal accommodating part accommodating any one of the plurality of connecting terminals therein, wherein the terminal accommodating part includes a first lock part, each of the plurality of connecting terminals includes a second lock part formed such that the second lock part and the first lock part are detachably locked to each other, and when any one of the plurality of connecting terminals is accommodated in the terminal accommodating part, the second lock part of the accommodated connecting terminal is locked by the first lock part so that the accommodated connecting terminal is detachably fastened in the terminal accommodating part.

7 Claims, 10 Drawing Sheets

(56) References Cited

U.S. PATENT DOCUMENTS

| | | | | | |
|---|---|---|---|---|---|
| 4,387,944 | A * | 6/1983 | Frear | H01R 13/424 | 439/595 |
| 4,387,945 | A * | 6/1983 | MacAvoy | H01R 13/426 | 439/595 |
| 4,394,058 | A * | 7/1983 | Frear | H01R 13/424 | 439/595 |
| 4,395,083 | A * | 7/1983 | Frear | H01R 13/424 | 439/595 |
| 4,406,507 | A * | 9/1983 | Eifler | H01R 13/424 | 439/595 |
| 5,518,428 | A * | 5/1996 | Onoda | H01R 13/4223 | 439/595 |
| 7,887,368 | B1 * | 2/2011 | Rossman | H01R 13/424 | 439/595 |
| 9,819,112 | B2 * | 11/2017 | Koester | H01R 13/436 | |

* cited by examiner

ELECTRICAL CONNECTOR WITH DETACHABLE CONNECTING TERMINALS

TECHNICAL FIELD

The invention relates to a connector used for wiring for devices such as a power source and the like.

BACKGROUND

High-current connectors used for power systems for vehicles or the like are known.

For instance, a device side shield connector described in patent document 1 includes a housing, male terminals, a shield shell and a seal ring. Inside the housing, a body part for accommodating the male terminals is formed. Inside the body part, a thick attaching wall is formed. The male terminals are attached by pressing and fitting them into press fit holes formed in the attaching wall.

[Patent Document 1] JP 2008-041600

The above-mentioned connector has the following problem. The shapes of connecting terminals are different depending on objects to which the connector is connected. For instance, the shapes of connecting terminals are different between the case where connecting terminals are mounted on a printed board and the case where connecting terminals are connected to coaxial terminals. However, in the connector described in patent document 1, the male terminals (connecting terminals) are attached by pressing and fitting them into the press fit holes, and therefore, the male terminals cannot be replaced. For this reason, it is difficult to use the connector, for users who want to replace the male terminals. Furthermore, according to the connector in patent document 1, dedicated housings differently designed for each type of male terminals are needed, and therefore, the production cost of the connectors increases.

SUMMARY

An object of the invention is to provide a connector in which a user can select any one of connecting terminals and attach it to a housing, and further replace it with another.

To achieve the object, a connector according to the present invention includes: a plurality of connecting terminals whose types are different from each other; and a housing including at least one terminal accommodating part accommodating any one of the plurality of connecting terminals therein. The terminal accommodating part includes a first lock part. Each of the plurality of connecting terminals includes a second lock part formed such that the second lock part and the first lock part are detachably locked to each other. When any one of the plurality of connecting terminals is accommodated in the terminal accommodating part, the second lock part of the accommodated connecting terminal is locked by the first lock part so that the accommodated connecting terminal is detachably fastened in the terminal accommodating part.

According to the connector, any one type of connecting terminal among the plural types of connecting terminals can be detachably attached to the terminal accommodating part. The connecting terminal can be replaced depending on the types of objects to be connected. Therefore, the connector is easy to use for users who want to replace the connecting terminal. Further, the second lock part of each of the connecting terminals is formed so as to be able to be locked to the first lock part. Namely, the respective second lock parts have the same configuration to be locked by the first lock part, regardless of the types of connecting terminals. Therefore, each of the plural types of connecting terminals can be attached to one type of terminal accommodating part. Accordingly, it is possible to reduce the production cost of the connector.

Further, in a connector according to the present invention, each of the plurality of connecting terminals may include a terminal part disposed in one end thereof and a connecting part disposed in the other end thereof. The terminal part of each of the plurality of connecting terminals is to be connected to a counterpart terminal of a counterpart connector. The connecting part of each of the plurality of connecting terminals is to be connected to any one of a plurality of different types of objects each of which the connector is to be connected to. The connecting parts of the plurality of connecting terminals may have different shapes from each other depending on the objects.

According to this aspect of the connector, a user can select one of the connecting terminals whose connecting part has a shape suitable for a selected object and attach the connecting terminal to the terminal accommodating part. As a result, the user can connect the connector to the selected object. In this way, the user can easily connect the connector to plural different types of objects.

Further, in a connector according to the present invention, the connecting part of one of the plurality of connecting terminals may have a shape to be connected to a board or a block. The connecting part of another of the plurality of connecting terminals may have a shape to be connected to a cable.

According to this aspect of the connector, when a user uses a board (e.g. a printed board) or a block (e.g. a terminal block) as an object to which the connector is connected, the user attaches one connecting terminal whose connecting part has a shape to be connected to a board or a block to the terminal accommodating part of the connector. When the user uses a cable as an object to be connected, the user attaches another connecting terminal whose connecting part has a shape to be connected to a cable to the terminal accommodating part of the connector. In this way, the user can flexibly select a suitable connecting terminal depending on the different types of objects.

Further, in a connector according to the present invention, each of the plurality of connecting terminals may include a holding member made of an insulating material and a terminal body made of a conductive material. In each of the plurality of connecting terminals, the terminal body may penetrate the holding member, the terminal part may be disposed on one end of the terminal body extending form the holding member in one direction, the connecting part may be disposed on the other end of the terminal body extending from the holding member in a direction opposite to said one direction, and the second lock part may be disposed in the holding member.

According to this aspect of the connector, in the plural different types of connecting terminals, the connecting parts of the terminal bodies are different from each other, whereas the holding members may be the same as each other. Therefore, when each of the plural different types of connecting terminals is produced, a common holding member can be used. Accordingly, it is possible to reduce the production cost of the connecting terminals.

Further, in a connector according to the present invention, the connector may further include: a shield shell made of a conductive material; and a waterproof seal made of an elastic material. The housing may include: an outer cylinder part formed in a cylindrical shape extending in a connecting direction in which the connector is connected to the counterpart connector; a flange part for attaching the connector to an attaching face, the flange part extending outward from an outer peripheral face of the outer cylinder part; and an inner cylinder part held inside the outer cylinder part by a holding part. The terminal accommodating part is disposed inside the inner cylinder part and formed in a cylindrical shape extending in the connecting direction. The shield shell is disposed on or above an outer peripheral face of the terminal accommodating part. The waterproof seal is disposed in the outer cylindrical part so as to come into intimate contact with the attaching face.

According to this aspect of the connector, the shield shell can cut off noise generated from the connecting terminal. The waterproof seal comes in intimate contact with the attaching face, and therefore, the waterproof seal can prevent water permeation. Thus, it is possible to provide a connector having a noise shield capability and a waterproof capability in addition to the function of easily replacing the connecting terminal.

Further, in a connector according to the present invention, the terminal accommodating part may include a partition wall dividing an inner space of the terminal accommodating part into a connecting space and an accommodating space. The partition wall may include a terminal insertion hole into which a tip part of any one of the plurality of connecting terminals is inserted. The tip part of said one of the plurality of connecting terminals may enter the connecting space from the accommodating space through the terminal insertion hole. The first lock part may be placed in the accommodating space.

According to this aspect of the connector, a part for connecting the connecting terminal to a counterpart terminal of a counterpart connector and a part for attaching the connecting terminal to the terminal accommodating part can be separately formed. Therefore, it is possible to adequately achieve both of the function of connecting the connecting terminal to the counterpart terminal and the function of detachably attaching the connecting terminal to the terminal accommodating part.

Further, in a connector according to the present invention, the partition wall may include a lock release hole for inserting a tool into the accommodating space from the connecting space in order to release the first lock part and the second lock part from each other.

According to this aspect of the connector, a user can easily remove the connecting terminal from the terminal accommodating part.

Furthermore, in a connector according to the present invention, the terminal accommodating part may include a lance part extending from an inner face of the terminal accommodating part. The first lock part may be disposed in a tip part of the lance part. The first lock part may include a first inclined face. The second lock part may include a second inclined face. When any one of the plurality of connecting terminals is inserted into the terminal accommodating part, the second inclined face touches and slides on the first inclined face, so that the first lock part is pushed by the second lock part.

According to this aspect of the connector, when a user inserts the connecting terminal into the terminal accommodating part, the first lock part and the second lock part are automatically locked to each other. Therefore, user can easily attach the connecting terminal to the housing.

DETAILED DESCRIPTION

Figure 1:
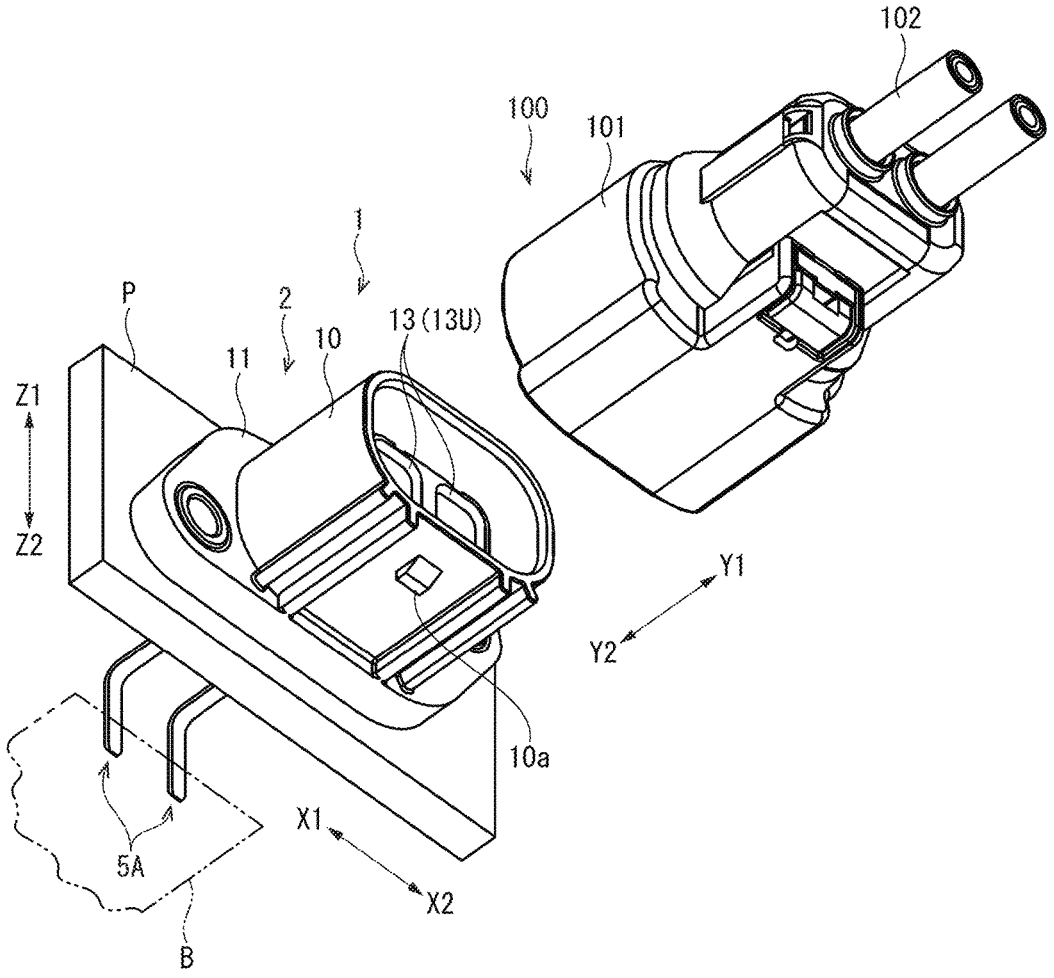
FIG. 1 is a perspective view showing a connector of an embodiment of the invention and a counterpart connector.

Preferred embodiments of the invention are shown by the following description and drawings. In the following description, when we need explanation about directions, we show it in accordance with the arrows depicted in the drawings. In the drawings, "X1" means "left", "X2" means "right", "Y1" means "front", "Y2" means "back", "Z1" means "up", and "Z2" means "down".

First, the outline of a connector 1 is shown by the following description and FIG. 1. FIG. 1 is a perspective view showing the connector 1 and a counterpart connector 100.

The connector 1 is attached to a panel P (an attaching face) and electrically connected to a printed board B (an object to be connected). The connector 1 is formed such that the connector 1 can fit into the counterpart connector 100. The counterpart connector 100 has a counterpart housing 101 and two counterpart terminals (not shown) accommodated inside the counterpart housing 101. The counterpart housing 101 is formed like a quadrangular cylinder whose back end face is opened. The counterpart terminals are fixed to tip parts of shield cables 102, respectively. The counterpart terminals are connected to connecting terminals 5A (described later) of the connector 1, respectively, when the connector 1 is fit into the counterpart connector 100. In this state, both the interior of the connector 1 and the interior of the counterpart connector 100 are sealed. The connector 1 and the counterpart connector 100 are used for, for instance, wiring for power sources for vehicles and the like, and have a noise shield capability and a water proof capability.

Figure 2:
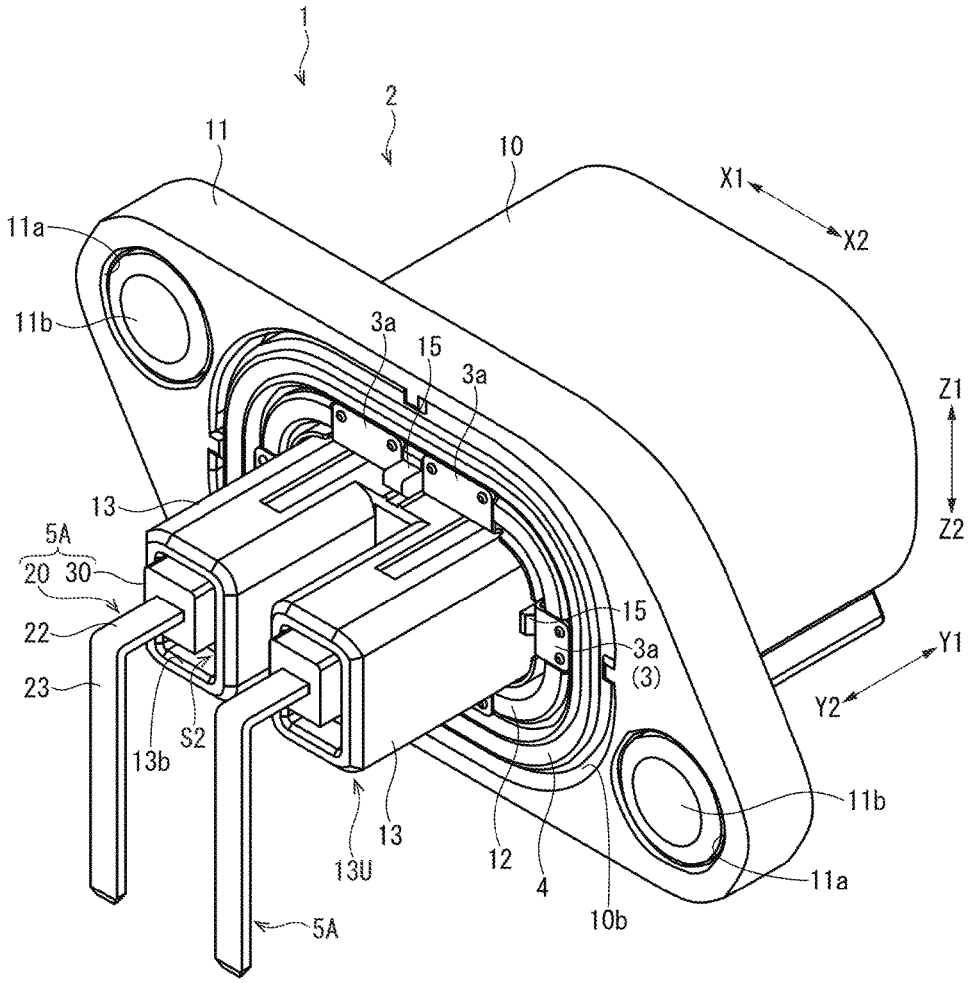
FIG. 2 is a perspective view showing a connector of an embodiment of the invention.
Figure 3:
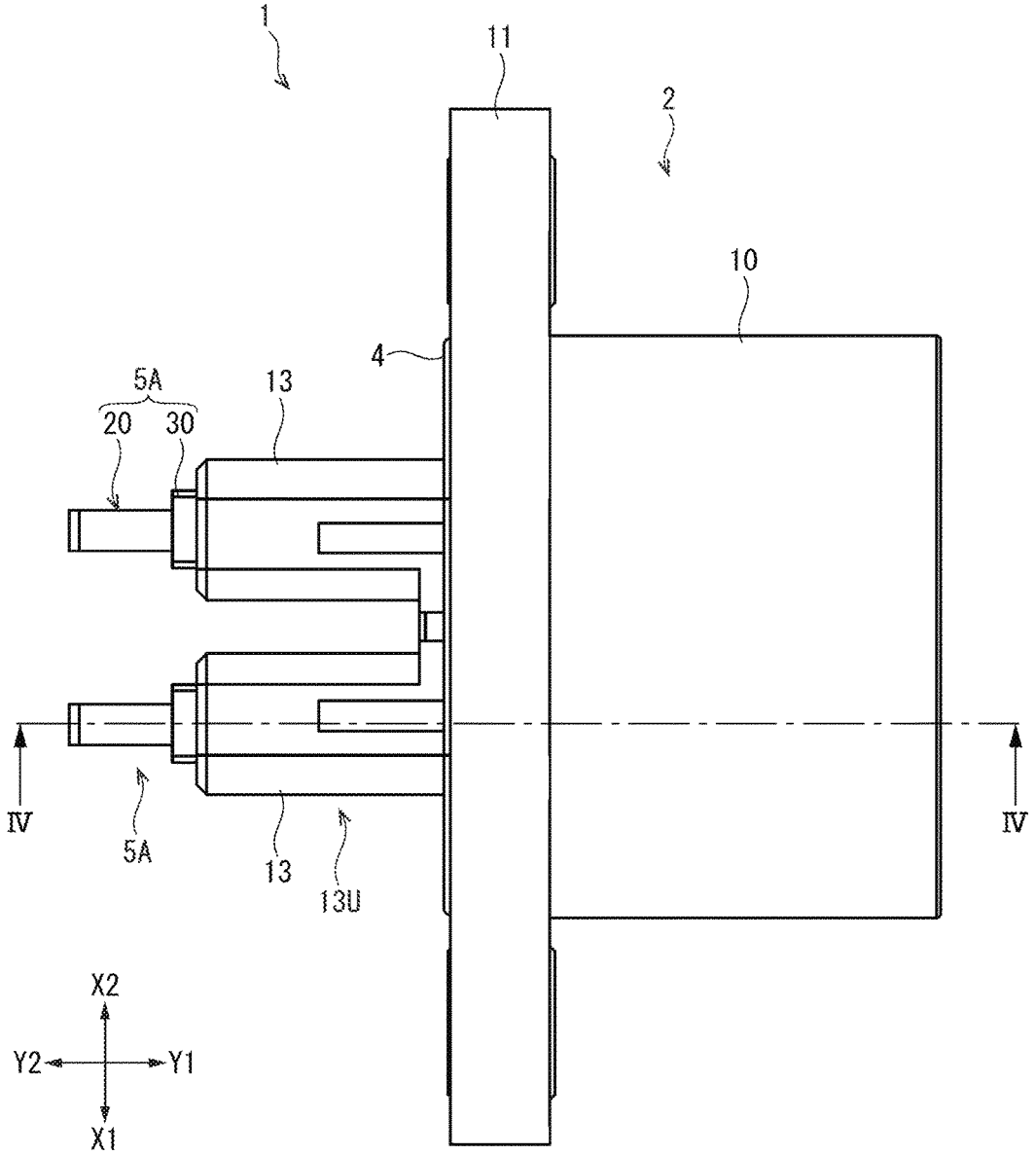
FIG. 3 is a plan view showing a connector of an embodiment of the invention.
Figure 4:
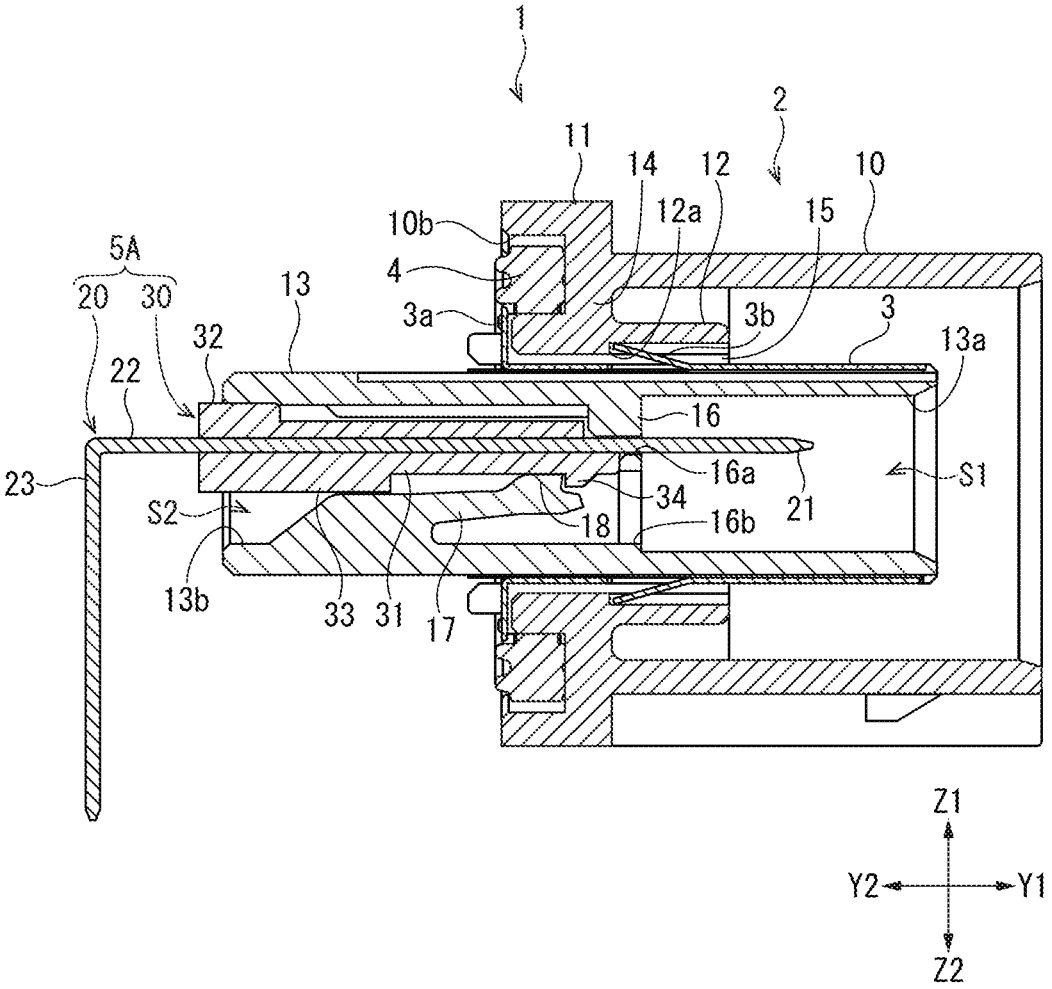
FIG. 4 is a sectional view showing the section of the connector along the line IV-IV in FIG. 3.

Next, the detailed features of the connector 1 are shown by the following description and FIG. 1 to FIG. 5. FIG. 2 is a perspective view showing the connector 1. FIG. 3 is a plan view showing the connector 1. FIG. 4 is a sectional view showing section IV-IV of the connector 1 in FIG. 3. FIG. is a sectional view showing the state in which the connecting terminal 5A is separated from a housing 2.

As shown in FIG. 2 and FIG. 3, the connector 1 includes the housing 2, a shield shell 3, a waterproof seal 4 and two connecting terminals 5A. The housing 2 mainly forms an outer shape of the connector 1. The shield shell 3 is placed in the interior of the housing 2. The waterproof seal 4 is placed at a back part (base end side) of the housing 2. The two connecting terminals 5A are detachably held by the housing 2.

The housing 2 includes an outer cylinder part 10, a flange part 11, an inner cylinder part 12, and two terminal accommodating parts 13. The housing 2 is made of, for instance, a synthetic resin material with an electrical insulation property.

As shown in FIG. 1, the outer cylinder part 10 is formed like a quadrangular cylinder whose front end face (which is positioned on the side where the connector 1 is connected to the counterpart connector 100) is opened. The outer cylinder part 10 has a section which is shaped like a horizontally long quadrangle and smaller than that of the counterpart connector 100. On a lower face of the outer cylinder part 10, a lock hook part 10*a*, which is engaged with a lock portion (not shown) formed inside the counterpart housing 101, is formed, and it is projected from the lower face.

As shown in FIG. 1 and FIG. 2, the flange part 11 extends outward in a radius direction from a back part of an outer peripheral face of the outer cylinder part 10. The flange part 11 is formed in the shape of a parallelogram when viewed from the front. On the left and right sides of the flange part 11, penetrating holes 11*a* are formed to insert bolts 11*b* therein. The two bolts 11*b* are inserted in the penetrating holes 11*a* from the front, penetrate the penetrating holes 11*a*, and screwed with female screw holes (not shown) of the panel P. In this way, the flange part 11 (the connector 1) is fixed to the panel P (see FIG. 1).

Figure 5:
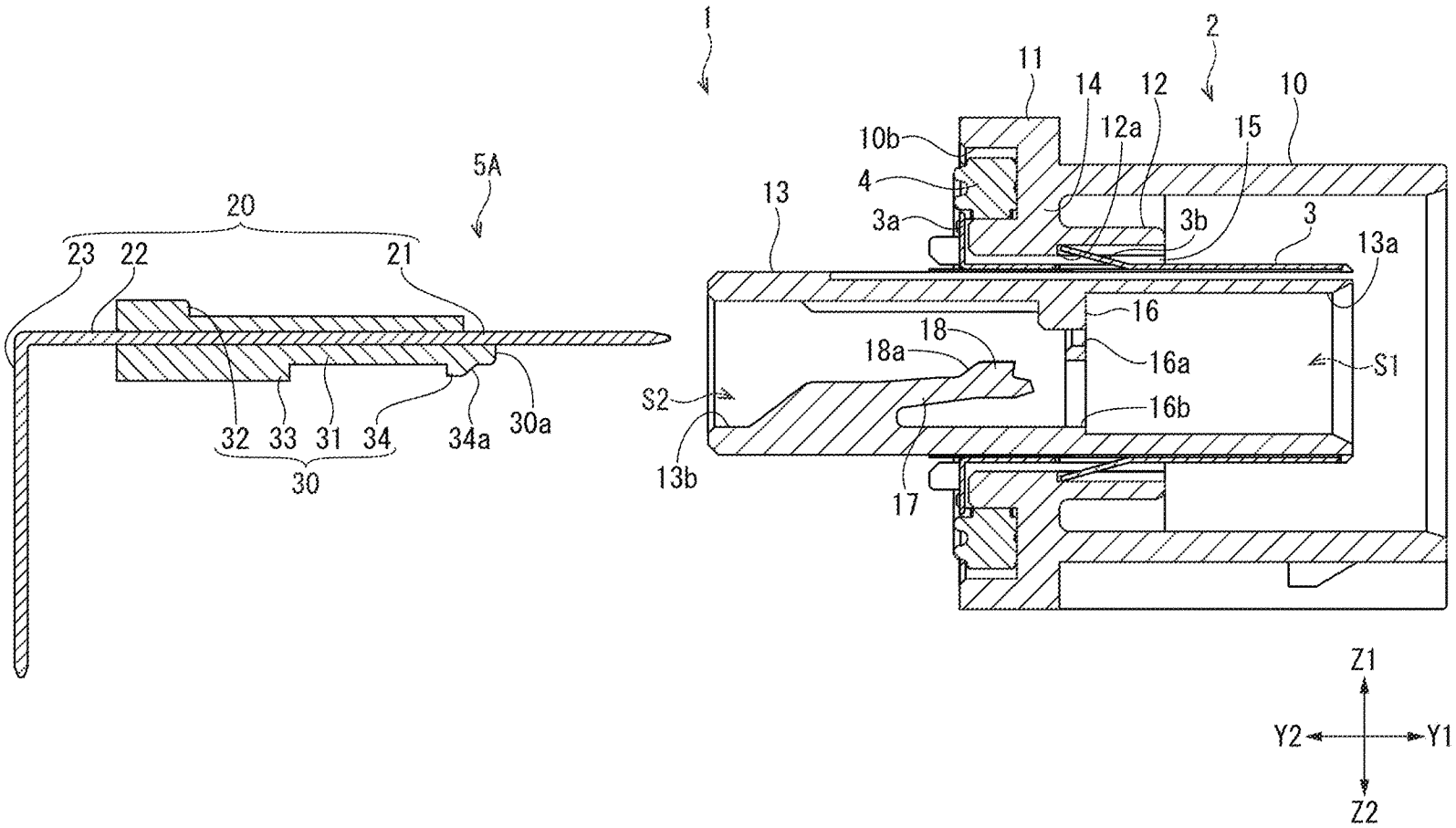
FIG. 5 is a sectional view showing a connector of an embodiment of the invention in the state where a connecting terminal is separated from a housing.

As shown in FIG. 4 and FIG. 5, the inner cylinder part 12 is placed in and connected to the interior of the outer cylinder part 10 via an outer holding part 14. The outer holding part 14 is positioned between the outer cylinder part 10 and the inner cylinder part 12 and formed like a ring extending a circumferential direction of them. The inner cylinder part 12 is formed like a quadrangular cylinder whose both front and back end faces are opened. The inner cylinder part 12 has the same axis as that of the outer cylinder part 10 and has a section which is shaped like a horizontally long quadrangle and smaller than that of the outer cylinder part 10. The inner cylinder part 12 is placed in a back part of the outer cylinder part 10. A front end face of the inner cylinder part 12 is positioned behind a front end of the outer cylinder part 10. A back end face of the inner cylinder part 12 is positioned at the approximately same position as those of back end faces of the outer cylinder part 10 and the flange part 11 such that those faces are placed on the approximately same plane.

As shown in FIG. 4 and FIG. 5, the two terminal accommodating parts 13 are placed inside the inner cylinder part 12. An accommodating unit 13U is formed by arranging the two terminal accommodating parts 13 in a left and right direction and unifying them (see FIG. 1 and FIG. 2). The accommodating unit 13U is connected to the inner cylinder part 12 by using four inner holding parts 15 placed on the upper, lower, left and right sides of the accommodating unit 13U.

The terminal accommodating parts 13 are placed so as to penetrate the inner cylinder part 12 in a front and back direction. Front end faces of the terminal accommodating parts 13 are positioned behind the front end of the outer cylinder part 10 and positioned in front of a front end of the inner cylinder part 12. Back parts of the terminal accommodating parts 13 extend behind the inner cylinder part 12 and the flange part 11. In the state where the connector 1 is attached to the panel P, the back parts of the terminal accommodating parts 13 project backward from the panel P.

At approximately center part in a front and back direction of each of the terminal accommodating parts 13, a partition wall 16 is formed. The partition wall 16 is formed in order to divide an interior space of the terminal accommodating part 13 into a connecting space S1 and an accommodating space S2. In a front end face of the terminal accommodating part 13, a connection opening part 13*a* is formed in order to insert the counterpart terminal of the counterpart connector 100 into the connecting space S1. In a back end face of the terminal accommodating part 13, a placement opening part 13*b* is formed in order to insert the connecting terminal 5A into the accommodating space S2.

In the partition wall 16, a terminal insertion hole 16*a* and a lock release hole 16*b* are formed. The terminal insertion hole 16*a* is formed on the upper side in the partition wall 16, that is, in the part upper than the center in an up and down direction in the partition wall 16. The terminal insertion hole 16*a* is opened in order to insert a tip part of the connecting terminal 5A, as described later. The lock release hole 16*b* is formed below the terminal insertion hole 16*a*. Incidentally, the tip part of the connecting terminal 5A is positioned behind the front end face of the terminal accommodating part 13 (the connection opening part 13*a*) in order to prevent a user from carelessly touching the tip part.

In the accommodating space S2, a lance part 17 is placed. The lance part 17 has a tip part which projects upward from a lower inner face of the terminal accommodating part 13 and then extends forward, and therefore, the lance part 17 is formed like an L shape when viewed from the left or right. The lance part 17 is formed so as to be elastically deformable in an up and down direction. A tip part of the lance part 17 is positioned near the lock release hole 16*b*. In an upper face of the tip part of the lance part 17, a locking hook 18 is formed so as to project from it. In a back face of the locking hook 18, an inclined face 18*a* (first inclined face) is formed so as to go up from the back side to the front side (from the upstream side to the downstream side in the attaching direction of the connecting terminal 5A) (see FIG. 5).

As shown in FIG. 4 and FIG. 5, the shield shell 3 is placed on or above an outer peripheral face of the two terminal accommodating part 13 (the accommodating unit 13U). Namely, the shield shell 3 is placed between the inner cylinder part 12 and the accommodating unit 13U. The shield shell 3 is made of, for instance, a conductive metal material. The shield shell 3 can cut off noise generated from the connecting terminals 5A.

In a back end of the shield shell 3, plural back end pieces 3*a*, which extend outward in a radius direction, are formed (also see FIG. 2). The plural back end pieces 3*a* touch the back end face of the inner cylinder part 12. In a middle part in an up and down direction of the shield shell 3, plural locking pieces 3*b*, which are formed by partially cutting the shield shell 3 and project outward in the radius direction, are formed. The plural locking pieces 3*b* are caught by step parts 12*a* formed in an inner face of the inner cylinder part 12.

The waterproof seal 4 is formed like a quadrangular ring (see FIG. 2). The waterproof seal 4 is made of, for instance, an elastically deformable synthetic rubber material. The waterproof seal 4 is placed in the outer cylinder part 10 so as to come into intimate contact with the panel P. Specifically, the waterproof seal 4 is fit into a seal groove 10*b*, which is formed like a quadrangular ring concave in the back end face of the outer cylinder part 10. In the state where the connector 1 is fixed to the panel P (see FIG. 1), the waterproof seal 4 is in intimate contact with the outer cylinder part 10 and the panel P and prevents water permeation.

As shown in FIG. 1 and FIG. 2, the two connecting terminals 5A are attached into the terminal accommodating parts 13 from the back, respectively. Each connecting terminal 5A is a so-called dip type terminal, which can be soldered on a printed board. Each connecting terminal 5A is one type of terminal selected from the plural types of terminals 5A, 5B, 5C and 5D, as described later. The plural types of terminals 5A-5D can be selectively and detachably accommodated in each of the terminal accommodating parts 13.

Figure 6A:
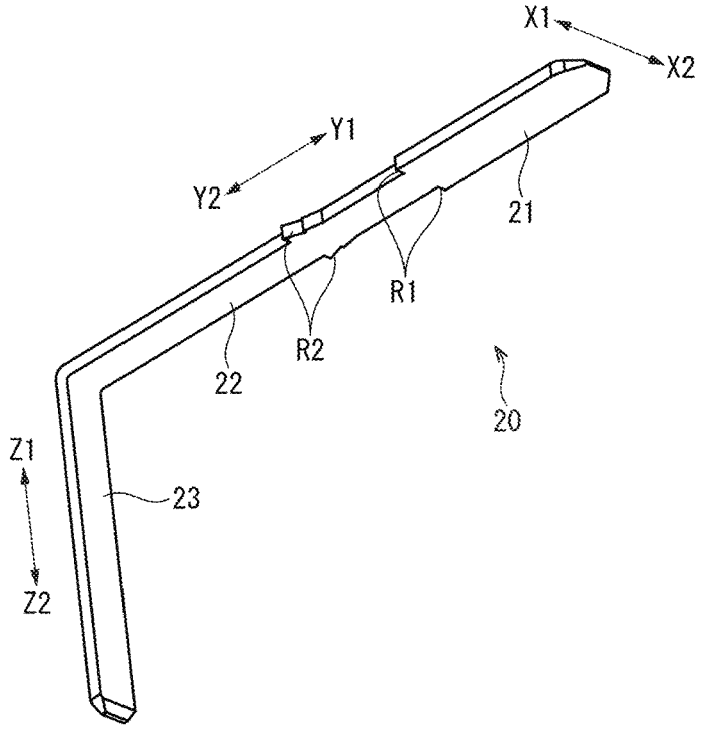
FIG. 6A is a perspective view showing a terminal body of a connector of an embodiment of the invention.
Figure 6B:
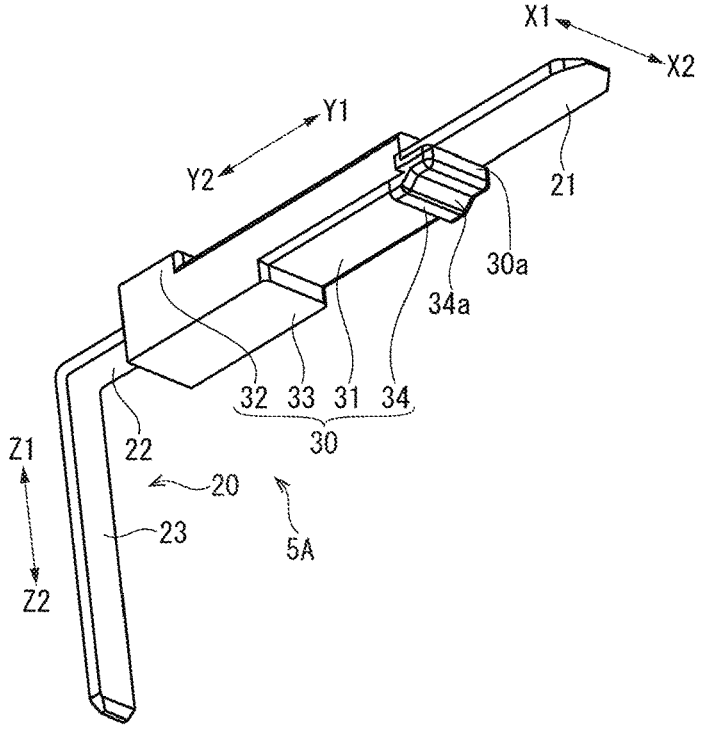
FIG. 6B is a perspective view showing a connecting terminal of a connector of an embodiment of the invention.

Next, the detailed features of the connecting terminals 5A are shown by the following description and FIG. 4 to FIG. 6B. FIG. 6A is a perspective view showing a terminal body 20. FIG. 6B is a perspective view showing the connecting terminal 5A. In the following description, explanation is made about one of the two connecting terminals 5A, which have the same shape. (The same goes for the connecting terminals 5B, 5C and 5D described later.)

As shown in FIG. 4 and FIG. 5, the connecting terminal 5A includes the terminal body 20 and a holding member 30. The terminal body 20 is made of, for instance, a conductive metal material. The holding member 30 is made of, for instance, a synthetic resin material with an electrically insulating property. Namely, the terminal body 20 and the holding member 30 are made of different materials from each other.

The terminal body 20 is formed by stamping it out of a thin metal plate and bending it. The terminal body 20 includes a terminal part 21, a mold part 22 and a connecting part 23.

As shown in FIG. 6A, the terminal part 21 is formed in a tip part of the terminal body 20, and is electrically connected to the counterpart connector 100 (the counterpart terminal). The mold part 22 extends backward from a back end part of the terminal part 21. The mold part 22 is formed like a board having a width (a length in a left and right direction) smaller than that of the terminal part 21. At the boundary between the mold part 22 and the terminal part 21, retaining steps R1 are formed. In left and right end faces of the mold part 22, retaining projections R2 are formed.

The connecting part 23 extends downward from a back end part of the mold part 22. The connecting part 23 bends at a right angle with respect to the mold part 22. The connecting part 23 can be inserted into a through hole (not shown) of the printed board B and soldered with it, and thereby electrically connected to the printed board B (see FIG. 1).

As shown in FIG. 6B, the holding member 30 is formed like a rectangular parallelepiped. The holding member 30 is molded so as to be integrated with the mold part 21. In such a structure, the terminal part 21 extends forward (toward one direction) from the holding member 30, and the connecting part 23 is positioned on the opposite side of the terminal part 21 across the holding member 30 (a base part of the connecting part 23 extends from the mold part 21 toward a direction opposite to said one direction).

As shown in FIG. 5 and FIG. 6, the holding member 30 includes a holding body 31, an upper side projecting part 32, a lower side projecting part 33 and a lock projection 34.

The holding body 31 is formed so as to cover from the retaining steps R1 to the position near the bent part. In other words, the terminal body 20 penetrates the holding member 30 in a front and back direction. The retaining projections R2 bite into the holding body 31, and therefore, the holding member 30 is fixed to the mold part 22 so as not to move in the front and back direction with respect to the mold part 22.

The upper side projecting part 32 is formed like a block and projects from an upper face of a back part of the holding body 31. The lower projecting part 33 is formed like a block and projects from a lower face of the back part of the holding body 31. The lower projecting part 33 is longer than the upper projecting part 32 in a front and back direction. The lock projection 34, which is an example of the second lock part, projects a lower face of a front part of the holding body 31. The lock projection 34 is formed at a part of the holding body 31 below the retaining steps R1. A front face of the lock part 34 has an inclined face 34*a* (second inclined face), which goes up from the back side to the front side. Incidentally, a lower side front part 30*a* of the holding body 31 extends further forward than the lock projection 34.

Here, we explain how to attach the connecting terminal 5A to the terminal accommodating part 13 by referring to FIG. 4 and FIG. 5.

As shown in FIG. 5, a user positions the housing 2 and the terminal connecting part 5A so as to make them face each other, and inserts the connecting terminal 5A into the accommodating space S2 through the placement opening part 13*b*. The terminal part 21 enters the connecting space S1 from the accommodating space S2 through the terminal insertion hole 16*a* of the partition wall 16 (see FIG. 4). When the connecting terminal 5*a* deeply enters, the upper side projecting part 32 of the holding member 30 touches an upper face of the inside of the terminal accommodating part 13, and the lower side projecting part 33 of the holding member touches a base end part of the lance part 17 (see FIG. 4). Further, the lock projection 34 (the inclined face 34*a*) touches the locking hook 18 (the inclined face 18*a*). The lock projection 34 (the inclined farce 34*a*) slides forward along the inclined face 18*a* while pushing down the lance part 17. When the lock projection 34 gets over the locking hook 18, the lance part 17 moves upward by its restoring force. Therefore, the lock projection 34 is locked by the locking hook 18, and the connecting terminal 5A is fastened in the terminal accommodating part 13 (see FIG. 4). In this way, the user can easily attach the connecting terminal 5A to the terminal accommodating part 13 by inserting the connecting terminal 5A to the terminal accommodating part 13. At this time, the lower side front part 30*a* of the holding member 30 (holding body 31) touches the partition wall 16 (see FIG. 4 and FIG. 5). Because of this, the connecting terminal 5A cannot move in a front and back direction.

Next, we explain how to remove the connecting terminal 5A from the terminal accommodating part 13. The user inserts a fine stick-shaped tool (not shown) into the connecting space S1 through the connection opening 13*a*. The tip part of the tool enters the accommodating space S2 through the lock release hole 16*b* of the partition wall 16, and then enters a part between the lock projection 34 and a tip part of the lance part 17 and pushes the part. As a result, the lance part 17 is pushed down, and therefore, the engagement of the lock projection 34 and the locking hook 18 is released. In this state, the user can remove the connecting terminal 5A by pulling it backward.

As described above, the connecting terminal 5A is one type of terminal selected from plural types of terminals 5A, 5B, 5C and 5D. In the connector 1 of this embodiment, the connecting terminal 5A attached to the terminal accommodating part 13 can be replaced with another connecting terminal selected from the connecting terminals 5B, 5C and 5D.

The plural types of connecting terminals 5A, 5B, 5C and 5D can be roughly divided in two groups. Each of the connecting terminals 5A, 5B and 5C is categorized as the connecting terminal (hereinafter referred to as a "first connecting terminal" as needed) to be mounted on the printed board B etc. (see FIGS. 6 to 8). The connecting terminal 5D is categorized as the connecting terminal (hereinafter referred to as a "second connecting terminal" as needed) to be connected to a cable 70 etc. (see FIG. 9). Incidentally, the above-described connecting terminal 5A is categorized as the first connecting terminal.

Figure 7:
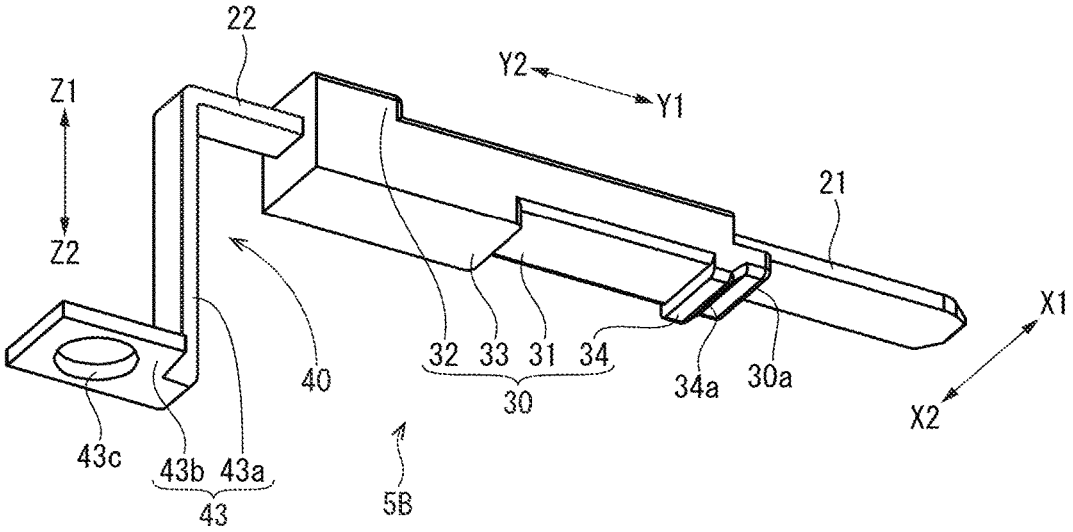
FIG. 7 is a perspective view showing a connecting terminal (bus bar type) of a connector of an embodiment of the invention.

Next, the connecting terminal 5B, which is categorized as the first connecting terminal, is shown by the following description and FIG. 7. FIG. 7 is a perspective view showing the connecting terminal 5B. Incidentally, in the following description, to the same elements of the connecting terminal 5B as those of the connecting terminal 5A, the same signs are given and the explanations are omitted.

The connecting terminal 5B is a so-called bus bar type terminal, which is to be connected to a terminal block (not shown) by using a bolt (not shown). The terminal block is an object to be connected. The connecting terminal 5B has a terminal body 40, which is different from the terminal body 20 of the connecting terminal 5A. Namely, in the connecting terminal 5B, the terminal body 40 penetrating the holding member 30 is one type of terminal body selected form plural types of terminal bodies 20 and 40. Specifically, the plural types of terminal bodies 20 and 40 have connecting parts 23 and 43 formed in different shapes, respectively (see FIG. 6 and FIG. 7). Incidentally, the plural types of terminal bodies 20 and 40 have the mold parts 22 formed in the same shape, respectively. Further, the plural types of connecting terminals 5A and 5B have the holding member 30 formed in the same shape, respectively.

The connecting part 43 of the connecting terminal 5B includes an extending part 43*a* and an attaching plate 43*b*. The extending part 43*a* bends at a right angle with respect to the mold part 22. The attaching plate 43*b* extends backward from a lower end of the extending part 43*a*. The attaching part 43*b* bends at a right angle with respect to the extending part 43*a*. The attaching part 43*b* has an insertion hole 43*c* so as to insert a bolt thereinto. The bolt is screwed with a female screw hole (not shown) of the terminal block through the insertion hole 43*c* from the upper side. In this way, the connecting terminal 5B is mounted on (or connected to) the terminal block.

Incidentally, since the methods of attaching and removing the connecting terminal 5B to/from the terminal accommodating part 13 are the same as those concerning the connecting terminal 5A, explanation about them is omitted.

Furthermore, in each of the connecting terminals 5A and 5B of the above-described embodiments, the holding member 30 is formed so as to be integrated with the terminal body 20 or 40. However, the invention is not limited to this. For instance, the terminal body 20 or 40 (the mold part 22) can be fixed by pressing it into the holding member 30. Instead of this, the holding member 30 can be bonded to the terminal body 20 or 40 with an adhesive.

Figure 8:
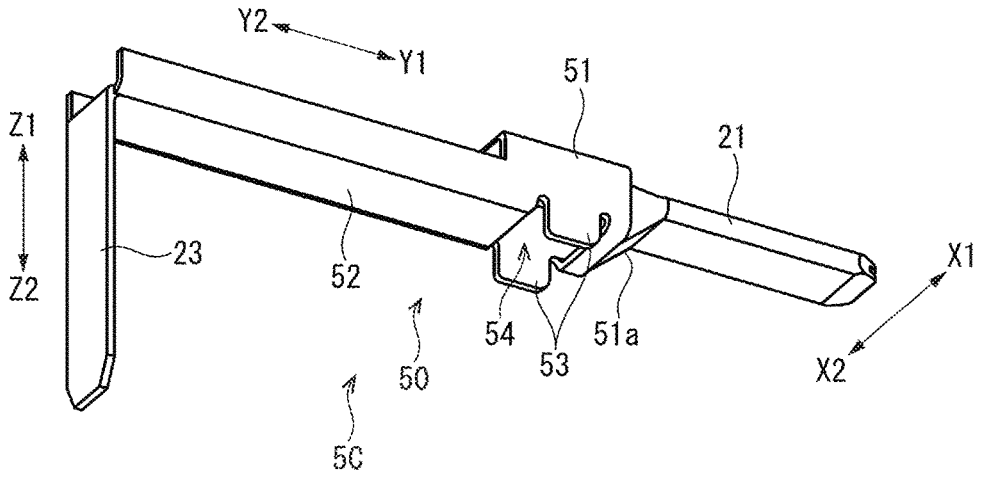
FIG. 8 is a perspective view showing a connecting terminal (not including a holding member) of a connector of an embodiment of the invention.

Next, the connecting terminal 5C, which is categorized as the first connecting terminal, is shown by the following description and FIG. 8. FIG. 8 is a perspective view showing the connecting terminal 5C. Incidentally, in the following description, to the same elements of the connecting terminal 5C as those of the connecting terminal 5A, the same signs are given and the explanations are omitted.

The connecting terminal 5C has a terminal body 50 made of metal but does not have a holding member 30 made of synthetic resin. The terminal body 50 of the connecting terminal 5C is formed by stamping it out of a thin metal plate and bending some parts of it. The terminal body 50 includes a terminal part 21, a lock cylindrical part 51, a linking part 52 and a connecting part 23. Incidentally, the connecting terminal 5C has approximately the same terminal part 21 and connecting part 23 as those of the connecting terminal 5A.

The lock cylindrical part 51 is connected to a back part of the terminal part 21. The lock cylindrical part 51 is formed like a quadrangular cylinder with a thickness larger than that of the connecting part 21 in an up and down direction. Namely, the lock cylindrical part 51 is formed so as to project with respect to the connecting part 21 in the up and down direction. In a lower face of a front part of the lock cylindrical part 51, an inclined face 51*a*, which becomes lower as it goes backward from the connecting part 21, is formed. In a lower face of the lock cylindrical part 51, a lock hole 54, which is shaped like a quadrangle when viewed from below, is formed. The lock hole 54 opens at the back side of the inclined face 51*a*. In the lower face of the lock cylindrical part 51, a couple of projecting pieces 53 is formed on the left and right sides of the lock hole 54. The projecting pieces 53 extend downward from both left and right edge of the lock hole 54. Incidentally, the inclined face 51*a* and the lock hole 54 are an example of the second lock part.

The linking part 52 extends backward from a back end of the lock cylindrical part 51. The linking part 52 links between the back end of the lock cylindrical part 51 and the connecting part 23. The linking part 52 is formed like a U-shaped groove when viewed from the back. Incidentally, the connecting part 23 is connected such that it bends at a right angle with respect to a bottom face of the U-shaped groove of the linking part 52.

Here, we explain how to attach the connecting terminal 5C to the terminal accommodating part 13. When the connecting terminal 5C enters the connecting space S1, the lock cylindrical part 51 (the inclined face 51*a*) touches the locking hook 18 (the inclined face 18*a* (see. FIG. 5)) of the lance part 17. When the connecting terminal 5C deeply enters, the lock cylindrical part 51 gets over the locking hook 18 while pushing down the lance part 17. Then, the lance part 17 moves upward by its restoring force, and the locking hook 18 of the lance part 17 (see. FIG. 4) enters lock hole 54. In this way, the connecting terminal 5C is fastened in the terminal accommodating part 13. Incidentally, the method of removing the connecting terminal 5*c* from the terminal accommodating part 13 is the same as the method of removing the connecting terminal 5A.

As described above, the lock cylindrical part 51 of the connecting terminal 5C has approximately the same function as that of the holding member 30 of the connecting terminal 5A or 5B. Namely, the lock hole 54 and the inclined face 51*a* are formed similarly in position and shape to the lock projection 34 and the inclined face 34*a* of the holding member 30 so as to be engaged with the lance part 17 (the locking hook 18).

Figure 9:
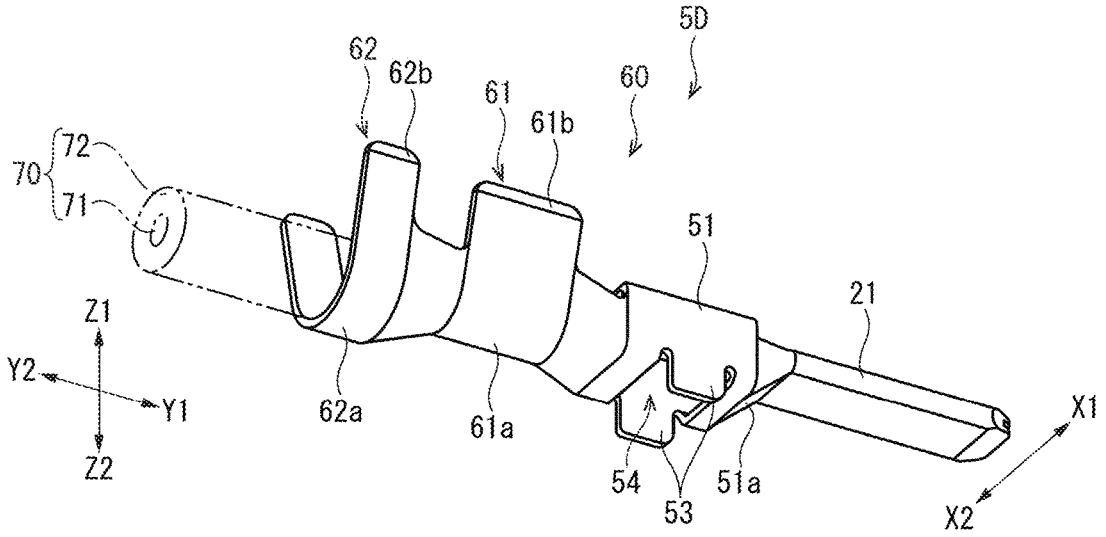
FIG. 9 is a perspective view showing a connecting terminal (shield cable connection type) of a connector of an embodiment of the invention.

Next, the connecting terminal 5D, which is categorized as the second connecting terminal, is shown by the following description and FIG. 9. FIG. 9 is a perspective view showing the connecting terminal 5D. Incidentally, in the following description, to the same elements of the connecting terminal 5D as those of the connecting terminal 5A or 5C, the same signs are given and the explanations are omitted.

The connecting terminal 5D is different from the above-described first connecting terminal (the connecting terminal 5A, 5B or 5C) in terms of connecting the tip part of the cable 70. The cable 70 has a conductor 71 covered with an exterior covering 72. Incidentally, although we do not depict in the figures, the base end part of the cable 70 is connected to the printed board B or another device etc.

Like the connecting terminal 5C, the connecting terminal 5D has a terminal body 60 made of metal. The terminal body 60 includes a terminal part 21, a lock cylindrical part 51, a conductor barrel part 61 and an insulator barrel part 62. Incidentally, the connecting terminal 5D has the same terminal part 21 and lock cylindrical part 51 as those of the connecting terminal 5C.

The conductor barrel part 61 is connected to the back part of the lock cylindrical part 51. The conductor barrel part 61 has a couple of conductor crimping pieces 61*b*, which are placed on the left and right sides and extend upward from a bottom face part 61*a*. The insulator barrel part 62 is connected to the back part of the conductor barrel part 61. The insulator barrel part 62 has a couple of insulator crimping pieces 62*b*, which are placed on the left and right sides and extend upward from a bottom face part 62*a*. The conductor barrel part 61 and the insulator barrel part 62 are respectively formed like a U-shaped when viewed from the back.

The conductor 71 exposed by terminating the cable 70 is put on the bottom face part 61*a* and crimped by the conductor crimping pieces 61*b*. The exterior covering 72 is put on the bottom face part 62*a* and crimped by the insulator crimping pieces 62*b*. In this way, the connecting terminal 5D is fastened to the tip part of the cable 70.

Incidentally, since the methods of attaching and removing the connecting terminal 5D to/from the terminal accommodating part 13 are the same as those concerning the connecting terminal 5C described above, explanation about them is omitted.

As described above, each of the plural types of connecting terminals 5A to 5D has the lock projection 34 or lock hole 54 which is locked by the locking hook 18 of the lance part 17 when each of the connecting terminals 5A to 5D is selected and accommodated in the terminal accommodating part 13. Here, in the following, we call any one type of connecting terminal among the plural types of connecting terminals 5A to 5D as a "terminal 5".

According to the connector 1, any one type of terminal 5 among the plural types of connecting terminals 5A to 5D can be detachably attached to one terminal accommodating part 13. Namely, the terminal 5 can be replaced depending on an object to be connected. Concretely, when the connector 1 is mounted on a printed board B which is a dip type board, the connecting terminal 5A (see FIG. 6) or the connecting terminal 5C (see FIG. 8) can be selected and attached to the terminal accommodating part 13. When the connector 1 is connected to a terminal block with a bolt, the connecting terminal 5B (see FIG. 7) can be selected and attached to the terminal accommodating part 13. When the connector 1 is connected to a printed board B via the cable 70, the connecting terminal 5D (see FIG. 9) can be selected and attached to the terminal accommodating part 13. Thus, a user can easily replace the terminal 5 depending on an object to which the connector 1 is to be connected. The connector 1 is easy to use for users who want to change an object to be connected.

Figure 10:
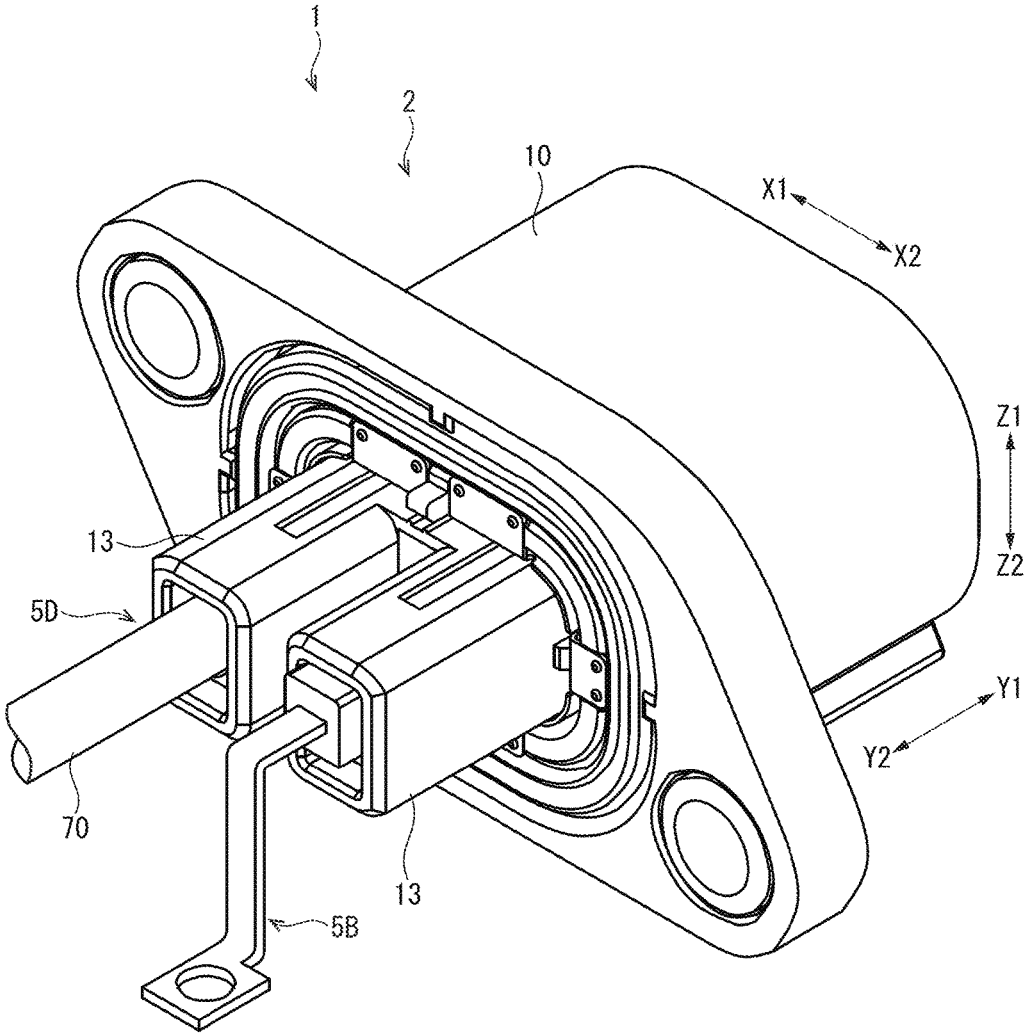
FIG. 10 is a perspective view showing an application of a connector of an embodiment of the invention.

Incidentally, in FIG. 2 or FIG. 3, the connector 1 to which the two connecting terminals 5A of the same type are attached to the two terminal accommodating parts 13 is shown. However, the invention is not limited to this. The two terminals 5 of different types can be attached to the two terminal accommodating parts 13, respectively. For instance, as shown in FIG. 10, the connecting terminal 5B can be attached to one of the two terminal accommodating parts 13, and the connecting terminal 5D can be attached to the other of the two terminal accommodating parts 13.

Further, in the connecting terminals 5A to 5D, both of the lock projection 34 and the lock hole 54 are formed so as to be locked by the lance part 17 (the locking hook 18). Namely, each of the lock projection 34 and the lock hole 54 has a common configuration which can be locked by the locking hook 18, regardless of the types of terminals 5. Therefore, one type of or single housing, i.e. the housing 2 can be used for the plural types of connecting terminals 5A to 5D. Accordingly, it is possible to reduce the production cost of the connecter 1.

Furthermore, according to the connector 1 of an embodiment of the invention, the connector 1 can be mounted on a printed board B, a terminal block or the like by attaching the first connecting terminals (the connecting terminals 5A, 5B or 5C) to the terminal accommodating parts 13. Further, the connector 1 can be connected to a cable 70 by replacing the first connecting terminal with the second connecting terminal (the connecting terminal 5D). Thus, the terminal 5 can be flexibly selected depending on an object to be connected, and it is possible to expand the range of uses of the connector 1.

Furthermore, according to the connector 1 of an embodiment of the invention, in the first connecting terminal, the plural types of terminal bodies 20 and 40 have the different connecting parts 23 and 43, respectively. Therefore, it is possible to apply various connecting methods to the connection of the connector 1 and objects to be connected.

Furthermore, each of the plural types of terminal bodies 20 and 40 has the same terminal part 21 and the same mold part 22. Moreover, each of the plural types of terminal bodies 20 and 40 is covered with the same holding member 30. Therefore, the common holding member 30 can be used regardless of the types of terminal bodies 20 and 40. Accordingly, it is possible to reduce the production cost of the connecting terminals 5A and 5B.

Incidentally, in the above-described embodiments, the first connecting terminal includes the dip type connecting terminals 5A, 5C and the bus bar type connecting terminal 5B. However, the invention is not limited to this. For instance, the first connecting terminal may be include connecting terminals for surface mounting.

Further, the connector 1 in the above-described embodiments has the two terminal accommodating parts 13 and the two terminals 5. However, the invention is not limited to this. The invention can be applied to a connector having a housing in which at least one terminal accommodating part 13 is formed. As for the number of terminals 5, the invention can be applied to a connector having at least one terminal 5 in response to the number of terminal accommodating parts 13. As for the counterpart connector 100, it is allowable to use a connector having at least one terminal in response to the number of terminal accommodating parts 13 or the number of terminals 5.

While the embodiments of the connector according to the invention have been described, it is to be understood that the invention is not limited to the embodiments except as defined in the appended claims.

Priority is claimed on Japanese application No. 2016-166705, filed Aug. 29, 2016, the content of which is incorporated herein by reference.

What is claimed is:

1. A connector comprising:

a plurality of connecting terminals whose types are different from each other; and a housing comprising at least one terminal accommodating part accommodating any one of the plurality of connecting terminals therein, wherein the terminal accommodating part comprises a first lock part, each of the plurality of connecting terminals comprises a second lock part formed such that the second lock part and the first lock part are detachably locked to each other, when any one of the plurality of connecting terminals is accommodated in the terminal accommodating part, the second lock part of the accommodated connecting terminal is locked by the first lock part so that the accommodated connecting terminal is detachably fastened in the terminal accommodating part, each of the plurality of connecting terminals comprises a terminal part disposed in one end thereof and a connecting part disposed in the other end thereof, the terminal part of each of the plurality of connecting terminals is to be connected to a counterpart terminal of a counterpart connector, the connecting part of each of the plurality of connecting terminals is to be connected to any one of a plurality of different types of objects each of which the connector is to be connected to, and the connecting parts of the plurality of connecting terminals have different shapes from each other depending on the objects.

2. The connector according to claim 1, wherein the connecting part of one of the plurality of connecting terminals has a shape to be connected to a board or a block, and the connecting part of another of the plurality of connecting terminals has a shape to be connected to a cable.

3. The connector according to claim 1, wherein each of the plurality of connecting terminals comprises a holding member made of an insulating material and a terminal body made of a conductive material, and in each of the plurality of connecting terminals, the terminal body penetrates the holding member, the terminal part is disposed on one end of the terminal body extending form the holding member in one direction, the connecting part is disposed on the other end of the terminal body extending from the holding member in a direction opposite to said one direction, and the second lock part is disposed in the holding member.

4. The connector according to claim 1, wherein the connector further comprises:

a shield shell made of a conductive material; and a waterproof seal made of an elastic material, the housing comprises:

an outer cylinder part formed in a cylindrical shape extending in a connecting direction in which the connector is connected to a counterpart connector;

a flange part for attaching the connector to an attaching face, the flange part extending outward from an outer peripheral face of the outer cylinder part; and an inner cylinder part held inside the outer cylinder part by a holding part, the terminal accommodating part is disposed inside the inner cylinder part and formed in a cylindrical shape extending in the connecting direction, the shield shell is disposed on or above an outer peripheral face of the terminal accommodating part, and the waterproof seal is disposed in the outer cylindrical part so as to come into intimate contact with the attaching face.

5. The connector according to claim 1, wherein the terminal accommodating part comprises a partition wall dividing an inner space of the terminal accommodating part into a connecting space and an accommodating space, the partition wall comprises a terminal insertion hole into which a tip part of any one of the plurality of connecting terminals is inserted, the tip part of said one of the plurality of connecting terminals enters the connecting space from the accommodating space through the terminal insertion hole, and the first lock part is placed in the accommodating space.

6. The connector according to claim 5, wherein the partition wall comprises a lock release hole for inserting a tool into the accommodating space from the connecting space in order to release the first lock part and the second lock part from each other.

7. The connector according to claim 5, wherein the terminal accommodating part comprises a lance part extending from an inner face of the terminal accommodating part, the first lock part is disposed in a tip part of the lance part, the first lock part comprises a first inclined face, the second lock part comprises a second inclined face, and when any one of the plurality of connecting terminals is inserted into the terminal accommodating part, the second inclined face touches and slides on the first inclined face, so that the first lock part is pushed by the second lock part.

* * * * *